US005138816A

United States Patent [19]

Holbrook et al.

[11] Patent Number: 5,138,816

[45] Date of Patent: Aug. 18, 1992

[54] MAIL HANDLING MACHINE WITH IMPROVED ENVELOPE FLAP OPENING MEANS

[75] Inventors: Russell W. Holbrook, Middlebury; Kevin J. O'Dea, Sandy Hook, both of Conn.

[73] Assignee: Pitney Bowes Inc., Stamford, Conn.

[21] Appl. No.: 743,653

[22] Filed: Aug. 12, 1991

[51] Int. Cl.[5] ..... B65B 43/39

[52] U.S. Cl. ..... 53/381.7; 53/387.2; 493/245

[58] Field of Search ..... 53/381.7, 381.5, 206, 53/284.3, 387.2, 387.1, 388.6, 376.3; 209/900, 546, 548; 493/245, 453

[56] References Cited

U.S. PATENT DOCUMENTS

| | | | |
|---|---|---|---|
| 3,996,727 | 12/1976 | Irvine et al. | 53/381.7 |
| 4,551,188 | 11/1985 | Schulze | 53/381.7 X |
| 4,955,483 | 9/1990 | O'Dea et al. | 209/546 X |
| 4,971,686 | 11/1990 | O'Dea et al. | 209/548 |
| 4,999,972 | 3/1991 | Foster | 493/245 X |

*Primary Examiner*—James F. Coan

*Attorney, Agent, or Firm*—Robert H. Whisker; Melvin J. Scolnick; David E. Pitchenik

[57] ABSTRACT

A mail handling machine includes a mechanism for serially transporting along a main path sealed and unsealed close-flapped envelopes, some of which may be mis-sealed. The machine also inlcudes a mechanism for opening the flaps of the unsealed close-flapped envelopes. The flap opening mechanism includes a shaped blade pivotally mounted on the machine and located along the main path. There is also a shaped portion of a deck that includes a fixed guide edge located along the path and downstream of the blade. The blade strips open the flaps of the unsealed envelopes. A member is hingedly mounted to the trailing edge of the blade. The member is biased so as to obstruct the gap between the blade and the guide edge to prevent opened flaps from entering the gap.

When a mis-sealed envelope engages the blade, causing the blade to move pivotally, the shaped portion cams up the member, which contacts the mis-sealed envelope and urges it out of engagement with the blade.

7 Claims, 6 Drawing Sheets

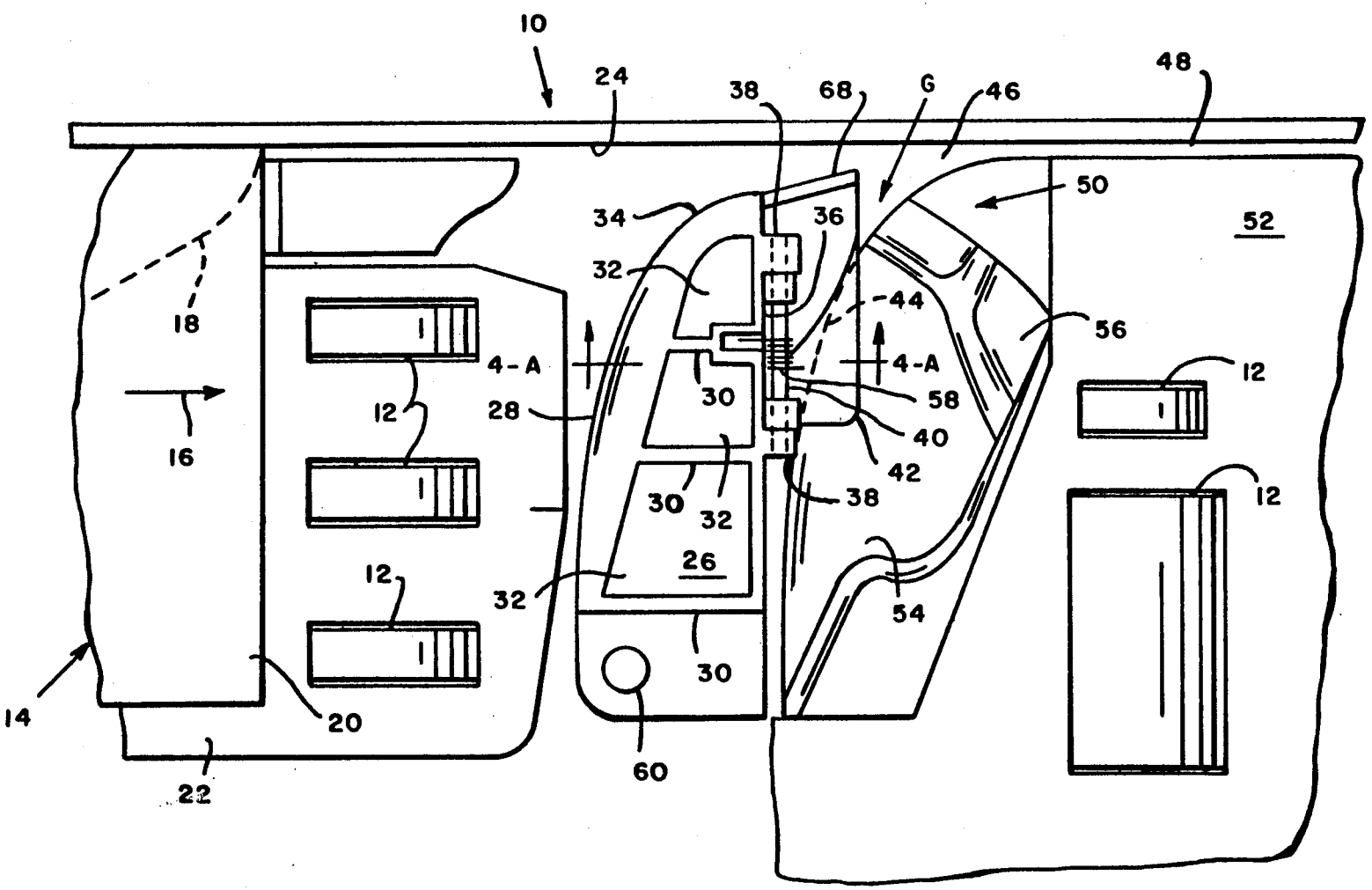
FIG. 2-A

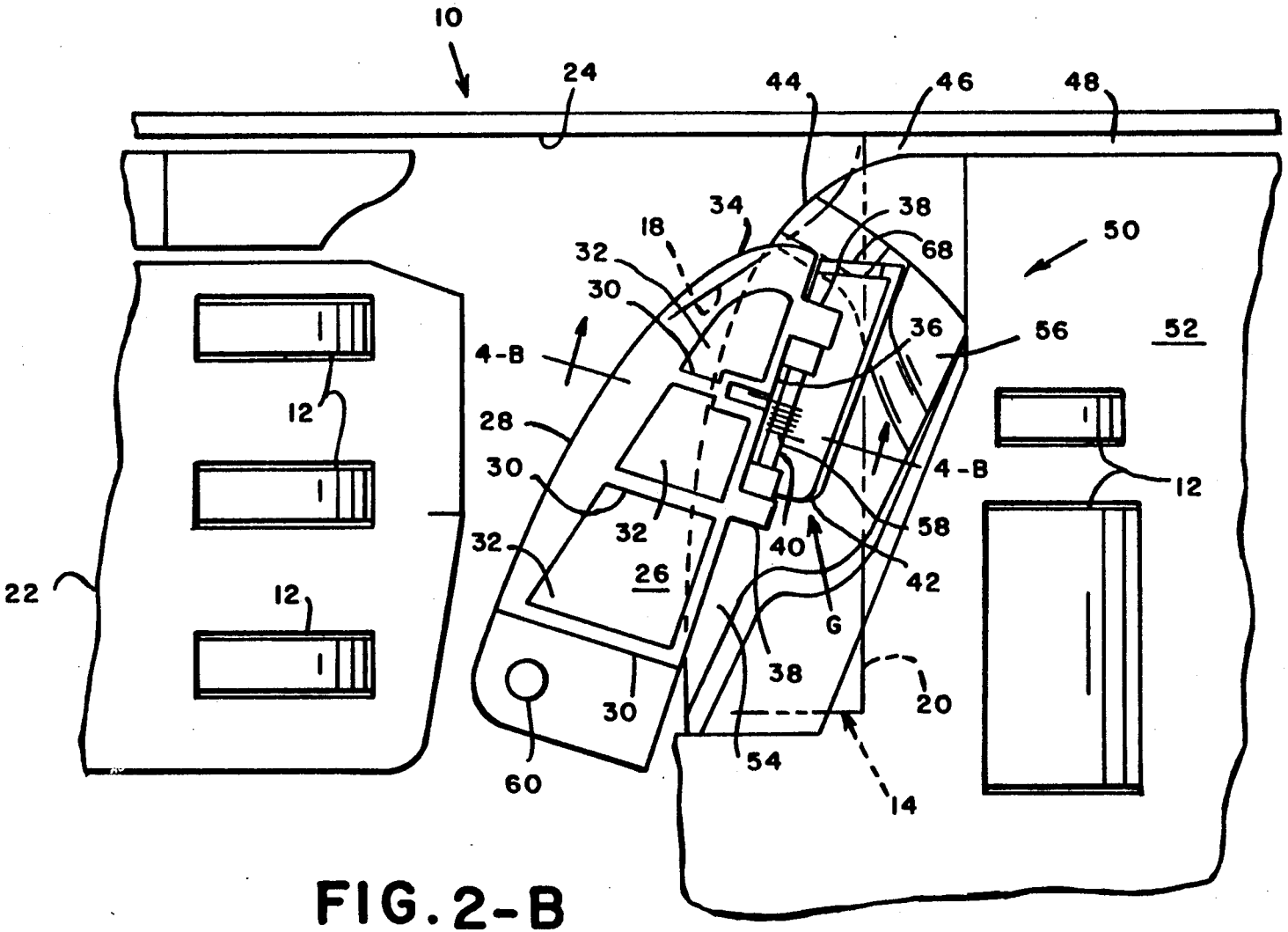
FIG. 2-B

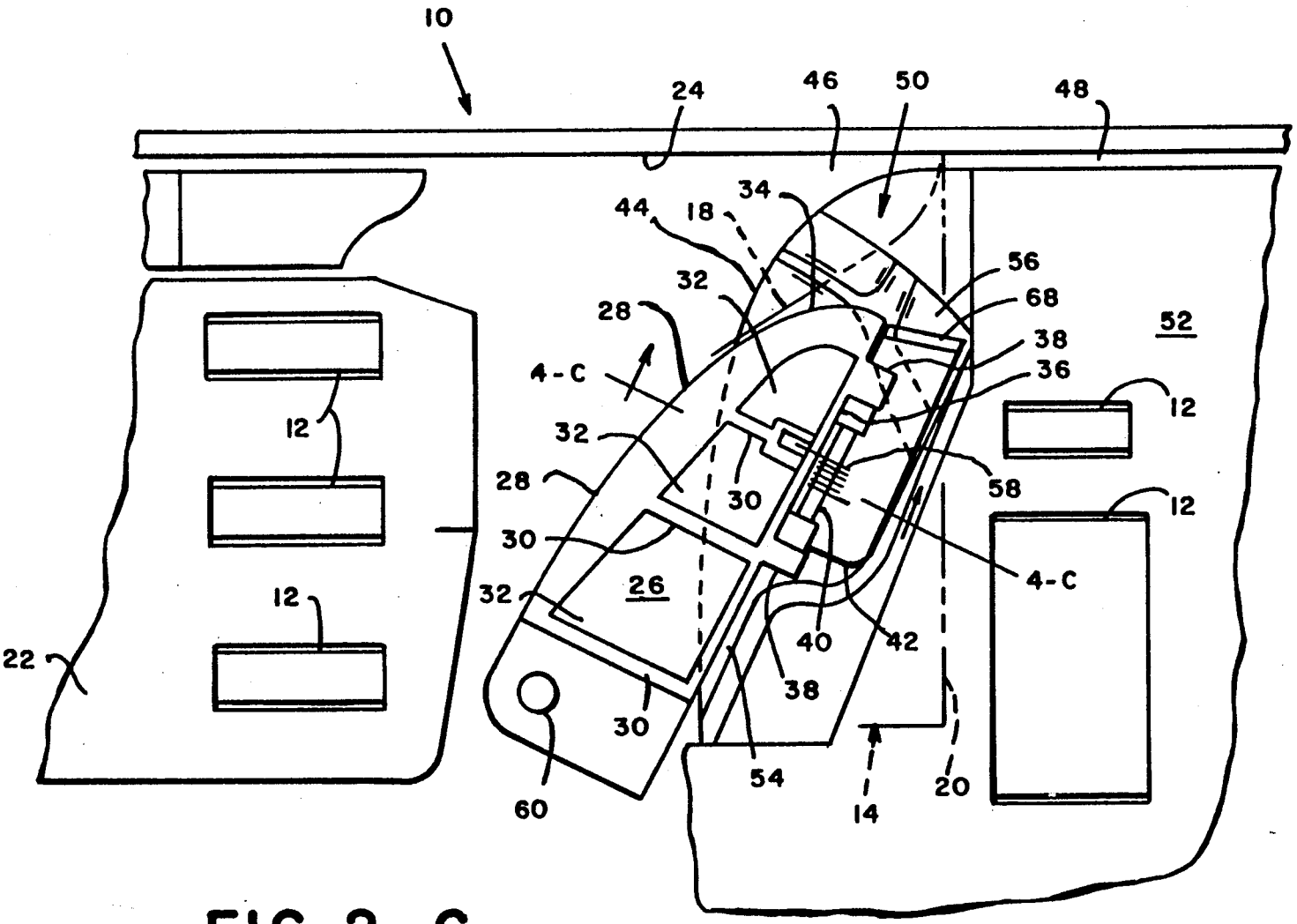
FIG. 2-C

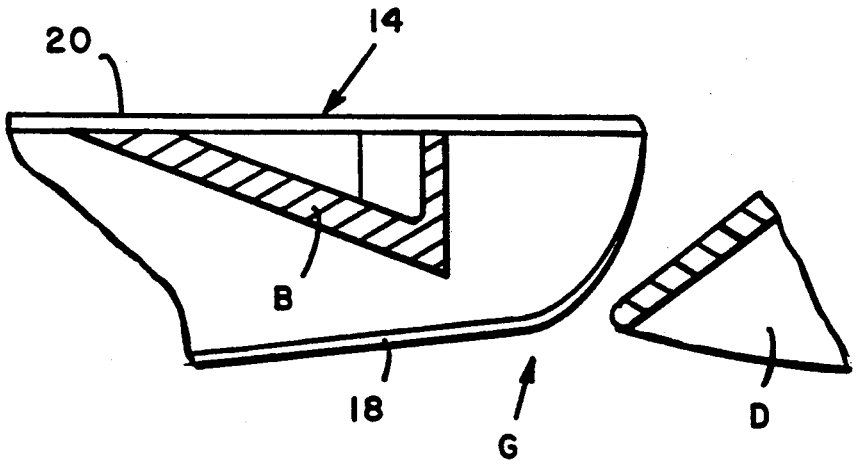
FIG. 3
(PRIOR ART)
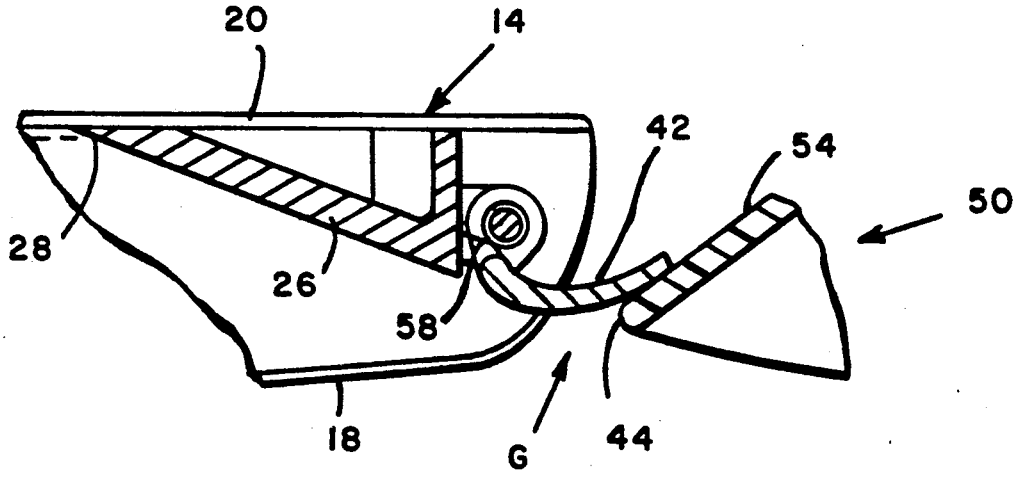
FIG. 4-A

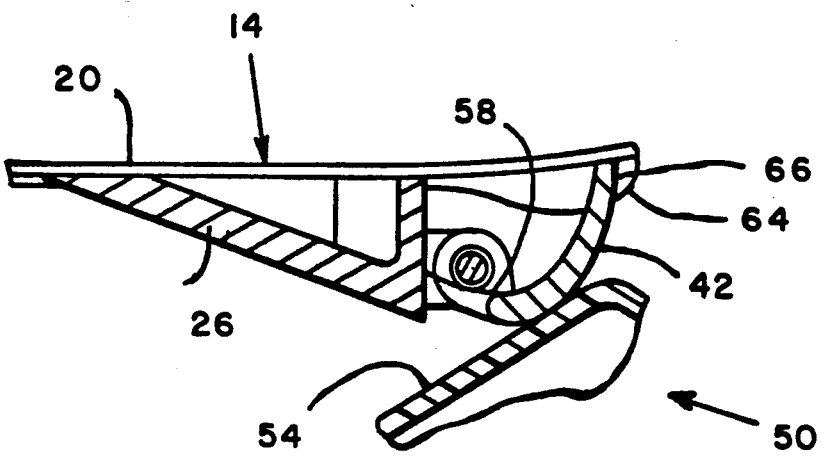
FIG. 4-B
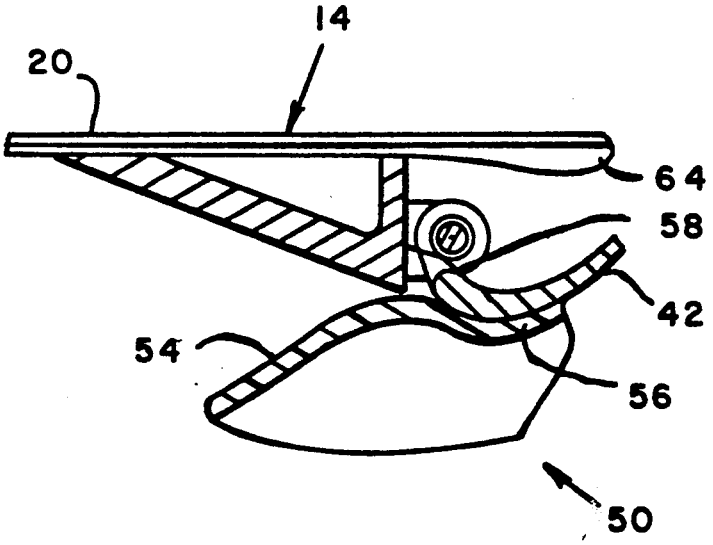
FIG. 4-C

MAIL HANDLING MACHINE WITH IMPROVED ENVELOPE FLAP OPENING MEANS

FIELD OF THE INVENTION

This invention relates to mail handling machines, and in particular to mail handling machines for processing mixed mail including sealed and unsealed envelopes.

BACKGROUND OF THE INVENTION

The disclosures of U.S. Pat. Nos. 4,955,483 and 4,971,686 are incorporated herein by reference. Those patents, which are assigned to the assignee of this application, disclose a mail handling machine with a main flowpath along which envelopes are serially transported. The envelopes are horizontally oriented for transport along a deck. The envelope flap is under the body of the envelope, i.e. between the body of the envelope and the deck. The envelope may either be sealed or unsealed.

If the envelope is unsealed, the machine opens the envelope flap at a flap opening station. In its open position, the flap extends downwardly, forming an angle of about 25° with the envelope body. The flap passes through a slot that extends beside the transport deck downstream from the opening station. While passing through the slot, the flap is moistened and subsequently the flap is sealed.

As disclosed in the above-cited patents, the flap opening station includes a pivotally mounted knife blade and a fixed guide edge that is spaced a short distance downstream from the blade. In the intended mode of operation of the opening station, the blade forces the flap open and, together with the guide edge, directs the flap into the slot. However, it has been found in some cases that the opened flap passes between the blade and the guide edge, resuming a horizontal, closed position rather than the desired downwardly extending open position. It is therefore desirable to modify the opening station so as to achieve more consistent opening of closed, unsealed envelopes.

SUMMARY OF THE INVENTION

According to the invention, a mail handling machine includes apparatus for transporting along a main path sealed and unsealed close-flapped envelopes. The machine also includes an apparatus for opening the flaps of the unsealed close-flapped envelopes. The flap-opening apparatus includes a shaped blade pivotally mounted on the machine and located along the main path, a fixed guide edge located along the path downstream of the blade, and a mechanism for obstructing a gap between the blade and the guide edge so as to prevent an opened flap from entering the gap.

According to one aspect of the invention, the blade has a trailing edge and the obstructing mechanism includes a member hingedly mounted to the trailing edge.

BRIEF DESCRIPTION OF THE DRAWINGS

FIGS. 2-A, 2-B and 2-C are plan views of the envelope opening station of FIG. 1, showing various positions of a flap opening blade.

FIG. 3 is a semi-schematic cross-sectional view of an opening station according to the prior art.

FIGS. 4-A, 4-B and 4-C are semi-schematic cross sectional views of the inventive envelope opening station, taken respectively along lines 4-A--4-A of FIG. 2-A, 4-B--4-B of FIG. 2-B, and 4-C--4-C of FIG. 2-C.

DETAILED DESCRIPTION OF THE PREFERRED EMBODIMENT

Figure 1:
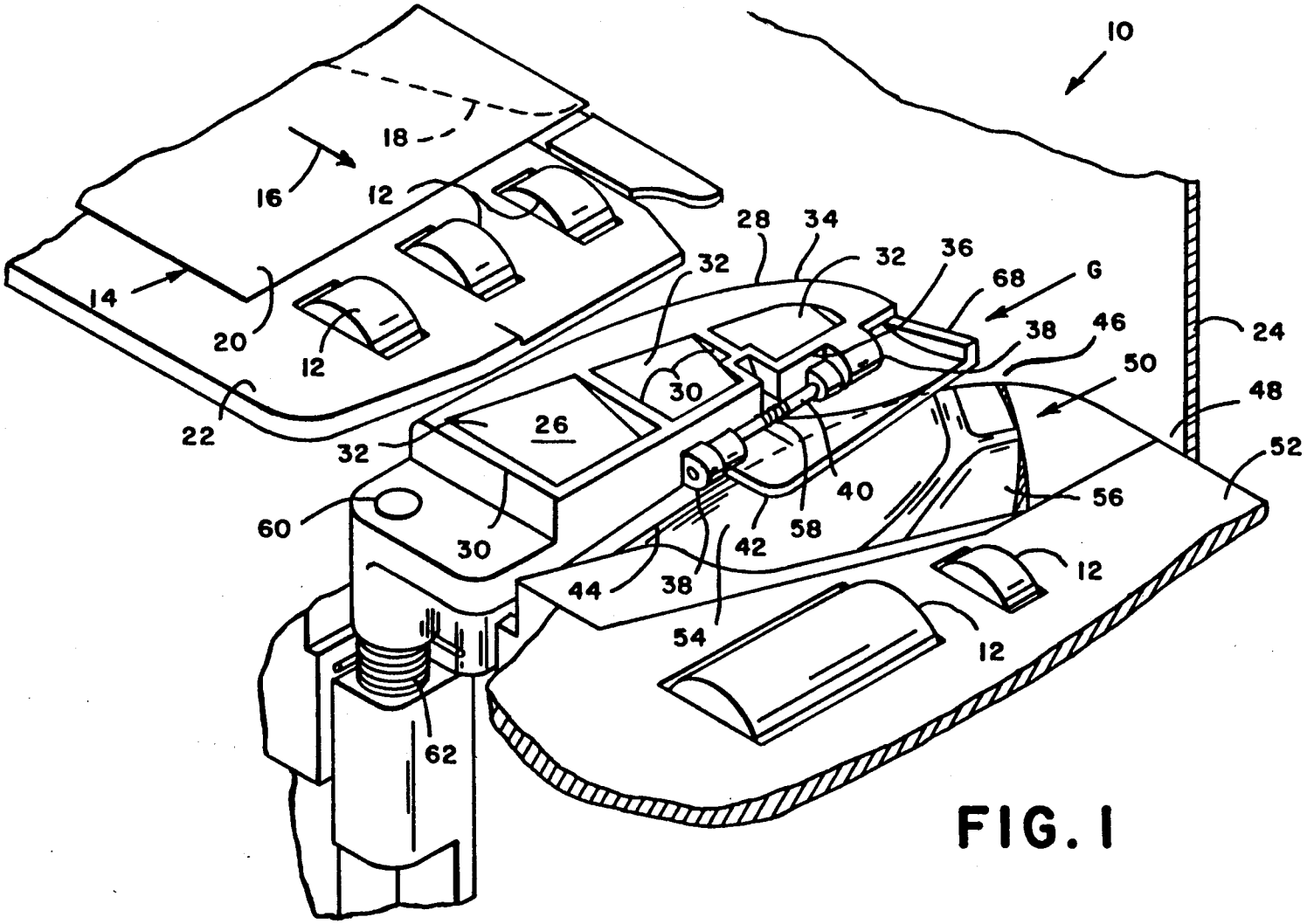
FIG. 1 is a perspective view of an envelope opening station in accordance with the invention.

The disclosure of U.S. Pat. No. 4,935,078, assigned to the assignee of this application, is incorporated herein by reference. The referenced U.S. Pat. No. 4,935,078, discloses a mail handling machine in which there may advantageously be incorporated an envelope opening station as will be described below.

FIG. 1 shows, in a perspective view, envelope opening station 10. Station 10 has conventional means, including for example rollers 12, for transporting an envelope 14 along a main envelope flow path, indicated by arrow 16. Envelope 14 is oriented so that its flap 18 is between the main body 20 of envelope 14 and deck 22. Flap 18 also passes adjacent to registration wall 24.

Station 10 also includes pivotally-mounted, airfoil shaped blade 26 which has a wedge-like cross-section, as shown in FIG. 4-A. Blade 26 has a sharp front edge 28, flat top sections 30, which optionally may be separated by cut out sections 32, and an end 34 that curves downstream. Blade 26 also has a trailing edge 36, which includes mounting brackets 38. Brackets 38 hold hinge 40, upon which is mounted flap member 42, which extends substantially horizontally downstream from trailing edge 36 of blade 26.

Downstream along the main flowpath a short distance from blade 26, is a fixed guide edge 44, which curves downstream toward registration wall 24 to form part of the entrance 46 of slot 48 (FIG. 2-A). Slot 48 extends downstream in the same direction as the main envelope path.

Guide edge 44 is part of shaped portion 50 of downstream deck extension 52. Shaped portion 50 includes an up-sloping part 54 (best seen in FIGS. 4-A, 4-B, 4-C) immediately downstream from guide edge 44. Shaped portion 50 also includes a concave nest 56 downstream from part 54.

Torsion spring 58, mounted on hinge 40, biases member 42 downward so that member 42 rests upon shaped portion 50 of deck extension 52.

Blade 26 is mounted on the mail-handling machine by means of pivot 60. Torsion spring 62 biases blade 26 in a counter clockwise direction towards a home position a shown in FIGS. 1 and 2-A.

It will now be assumed that envelope 14 is an unsealed envelope. It will therefore be the function of station 10 to open the envelope so that flap 18 is caused to extend downwardly and to pass through slot 48 for moistening and subsequent sealing, as discussed in the above-referenced U.S. Pat. Nos. 4,955,483 and 4,971,686. As described in those patents, flap 18 is forced below blade 26 while the main body of the envelope continues over blade 26. Station 10 preferably includes a means (not shown), such as deflection finger 37 of U.S. Pat. Nos. 4,955,483 or 4,971,686, that begins to separate flap 18 from main body 20 as the envelope 14 reaches blade 26.

As seen in FIGS. 1 and 2-A, there is a gap G, between blade 26 and guide edge 44. In prior designs such a gap G (FIG. 3) was also present between a blade B and a deck extension D and, it was found that flap 18 would sometimes enter the gap instead of the moistening slot. Flap 18 would then move along with envelope 14 over the deck extension so that envelope 14 would be closed, but not sealed, upon exiting the opening station. In short, flap 18 would bypass the moistening station and envelope 14 would fail to be sealed. However, in the opening station 10 of the present invention, member 42 obstructs gap G (as best seen in FIG. 4-A), thereby preventing flap 18 from entering gap G and preventing envelope 14 from reclosing.

It is within the contemplation of the invention that envelopes will arrive at station 10 with the flap already open, i.e. extending downwardly, substantially parallel to registration wall 24. In this case, the flap is not opened by blade 26, but member 42 still prevents the flap from entering gap G, thus insuring that the flap 18 enters slot 48 for moistening prior to sealing.

It will next be assumed that envelope 14 is sealed before entering station 10 and that flap 18 adheres tightly to the main body of envelope 14. In this case envelope 14 is simply transported by rollers 12 through station 10 without engaging blade 26 and without the position of flap 18 being changed by blade 26.

In the three cases previously discussed (1) closed, unsealed envelope; (2) open, unsealed envelope; and (3) well sealed envelope—blade 26 remains essentially stationary. In cases (2) and (3), blade 26 does not engage envelope 14 or flap 18; In case (1), although blade 26 engages flap 18 so as to strip it open, the tension of spring 62 is chosen so that the force required to strip open the flap does not exceed the spring tension. Blade 26 therefore remains in its home position, as noted in above-referenced U.S. Pat. Nos. 4,955,483 and 4,971,686. However, in a fourth case, it may happen that envelope 14 is improperly sealed, so that a loop 64 (FIGS. 4-B, 4-C) is formed at the leading edge of flap 18. In that case, loop 64 may engage blade 26, resulting in motion of blade 26 and member 42, as shown in FIGS. 2-B, 2-C, 4-B and 4-C.

Referring now in FIG. 2-B, it will be seen that blade 26 has been deflected by envelope 14 to an intermediate position. As shown in FIG. 4-B, the movement of blade 26 to its position of FIG. 2-B, has caused member 42 to be cammed upwards by up-slope 54 of shaped portion 50. Thus tip 66 of member 42 presses upwardly on envelope 14, tending to disengage loop 64 from blade 26. The flap disengaging action of member 42 is enhanced by raised lip 68 (best seen in FIG. 1) of member 42. Lip 68 is at the part of member 42 that is closest to registration wall 24. By the time blade 26 moves to its fully deflected position of FIG. 2-C, the combination of the disengaging action of member 42 and the further deflection of blade 26 causes loop 64 to disengage from blade 26. Envelope 14 is now free to be transported across deck 52 and out of opening station 10. At this same time, member 42 is urged downward by spring 58 into nest 56, so that member 42 does not impede the progress of envelope 14.

The disengaging action of member 42 has been found to improve station 10's handling of mis-sealed envelopes so that the magnet and Hall-effect detector of U.S. Pat. Nos. 4,955,483 and 4,971,686 can be dispensed with. It will be observed that member 42 performs two functions: prevention of the "destripping" of flaps 18 by entry into gap G and aiding in the disengagement of missealed envelopes from blade 26. It is within the contemplation of the invention that only one of these functions be availed of, as for example in an application in which only unsealed envelopes are processed by the mail handling machine.

An additional benefit of lip 68 of member 42 should also be noted. When the mailing machine is operated in a no-seal mode (referred to at col. 7, line 28 to col. 8, line 14 of the above-cited U.S. Pat. No. 4,971,686), lip 68 aids in guiding envelopes away from gap G, thus preventing jams.

While the invention has been described and illustrated in connection with a preferred embodiment, many variations and modifications as will be evident to those skilled in this art may be made therein without departing from the spirit of the invention, and the invention as set forth in the appended claims is thus not to be limited to the precise details of construction set forth above as such variations and modifications are intended to be included within the scope of the appended claims.

What is claimed is:

1. A mail handling machine comprising:

(a) means for serially transporting along a main path unsealed close-flapped envelopes; and, (b) means for opening the flaps of said unsealed close-flapped envelopes; said flap opening means comprising a shaped blade mounted on said machine and located along said main path, a fixed guide edge located along said main path downstream of said blade, and means for obstructing a gap between said blade and said guide edge so as to prevent an opened flap from entering said gap.

2. The machine of claim 1, wherein said blade has a trailing edge and said obstructing means comprises a member hingedly mounted to said trailing edge.

3. The machine of claim 2, wherein said fixed guide edge is part of a shaped portion of a deck and wherein said obstructing means further comprises biasing means for biasing said member into contact with said shaped portion.

4. A mail handling machine comprising:

(a) means for serially transporting along a main path sealed and unsealed close-flapped envelopes, some of which may be mis-sealed envelopes;

(b) means for opening the flaps of said unsealed close-flapped envelopes, said flap opening means comprising a shaped blade pivotally mounted on said machine and located along said main path, said blade having a trailing edge; and (c) disengagement means for disengaging from said blade a mis-sealed envelope that engages said blade; said disengagement means comprising a member hingedly mounted to said trailing edge.

5. The machine of claim 4, wherein said disengagement means further comprising camming means for upwardly camming said member upon pivotal movement of said blade.

6. The machine of claim 5, wherein said camming means comprises a shaped portion of a deck, said portion being located along said main path downstream from said blade.

7. A mail handling machine comprising:

(a) means for serially transporting along a main path sealed and unsealed close-flapped envelopes, some of which may be mis-sealed;

(b) means for opening the flaps of said unsealed close-flapped envelopes, said flap opening means comprising a shaped blade pivotally mounted on said machine and located along said main path and a shaped portion of a deck, said shaped portion including a fixed guide edge located along said main path and downstream of said blade, said blade having a trailing edge, said blade for stripping open the flaps of said unsealed close flapped envelopes;

(c) a member hingedly mounted to said trailing edge; and (d) means for biasing said member into contact with said shaped portion so as to obstruct a gap between said blade and said guide edge so as to prevent said opened flaps from entering said gap;

said shaped portion camming up said member upon pivotal motion of said blade so as to cause said member to disengage from said blade a mis-sealed envelope that comes into engagement with said blade.

* * * * *